US005975249A

United States Patent [19]

Tomaseti

[11] Patent Number: 5,975,249

[45] Date of Patent: Nov. 2, 1999

[54] LIFT CAGE

[75] Inventor: Fabrice Tomaseti, Wittenheim, France

[73] Assignee: Inventio AG, Switzerland

[21] Appl. No.: 09/034,473

[22] Filed: Mar. 4, 1998

[30] Foreign Application Priority Data

Mar. 6, 1997 [CH] Switzerland ..... 0532/97

[51] Int. Cl.[6] ..... B65B 11/02

[52] U.S. Cl. ..... 187/401

[58] Field of Search ..... 187/401, 414; 52/79.1, 264, 30, 27.5

[56] References Cited

U.S. PATENT DOCUMENTS

| | | | |
|---|---|---|---|
| 3,380,212 | 4/1968 | Bompadre | 52/264 |
| 3,631,942 | 1/1972 | Brounn | 187/401 |
| 3,707,205 | 12/1972 | Gibson | 187/401 |
| 4,112,649 | 9/1978 | Fritsch et al. | 52/726.1 |
| 4,258,511 | 3/1981 | Strain | 52/79.1 |
| 4,683,988 | 8/1987 | Strum, Jr. . | |
| 4,699,251 | 10/1987 | Orndorff et al. | 187/401 |
| 4,700,809 | 10/1987 | Lazar | 187/401 |
| 4,875,552 | 10/1989 | Smith et al. | 187/401 |
| 5,036,634 | 8/1991 | Lessard et al. | 52/79.1 |
| 5,325,937 | 7/1994 | Suchodolski et al. | 187/401 |
| 5,351,787 | 10/1994 | Hoch et al. . | |
| 5,398,465 | 3/1995 | Tagg | 52/79.1 |
| 5,564,529 | 10/1996 | Ericson et al. | 187/401 |

FOREIGN PATENT DOCUMENTS

| | | | |
|---|---|---|---|
| 75552 | 1/1988 | Australia . | |
| 1851338 | 9/1958 | Germany . | |
| 2-152891 | 6/1990 | Japan | 187/401 |
| 5-132269 | 5/1993 | Japan | 187/401 |
| 496286 | 11/1938 | United Kingdom . | |

*Primary Examiner*—Christopher P. Ellis
*Assistant Examiner*—Thuy V. Tran
*Attorney, Agent, or Firm*—Schweitzer Cornman Gross & Bondell LLP

[57] ABSTRACT

Lift cage for a lift, which is movable upon vertical guide rails by a lifting device, has walls assembled from sheet metal members, a cage ceiling and a cage base. Some of the wall-forming profile members form supporting frame members which together with horizontal base beams, form a cantilever sling for the lift cage. The supporting frame members serve both as the cage body wall elements as well as cage support members.

10 Claims, 4 Drawing Sheets

LIFT CAGE

The present invention relates to a lift cage for an elevator or lift which is movable along vertical guide rails by a lifting device. The lift cage has walls which are composed of sheet metal members having at least partially bent or folded edges forming profile sections. Certain of the wall-forming members extend downwardly beyond the lift cage base element to form supporting frame members for The lift cage.

BACKGROUND OF THE INVENTION

German Utility Model No. 1 851 338 describes and shows a cage construction of The aforesaid kind. Individual wall members for the side walls have longer limbs and extend as so-called side panel profile sections beyond the upper edge of the lift cage and form, together with similar enlarged ceiling profile sections, an upper carrier yoke. A suspension bracket for the carrying elements can be incorporated into this carrier yoke.

The teaching of this Utility Model is confined to the formation of an upper carrier yoke by means of sheet metal profile sections and the side panel profile sections connected therewith, whereby an upper suspension point for a lift cage is provided. The construction of the overall cage body is not disclosed or evident therefrom, and thus it is not known how the rigidity of the overall lift cage with this suspension construction is insured. A suspension of the illustrated kind has to be arranged as centrally as possible so as to avoid distortion of the cage body.

BRIEF DESCRIPTION OF THE INVENTION

The present invention has as an object the creation, by means of sheet metal plates and sheet metal profile sections, of a lift cage which can be guided and suspended eccentrically.

This and further objects are met by the present invention, wherein cage wall members form a cantilever sling for the guidance of the lift cage at one side of the cage on guide rails. Base beams connected to the supporting frame members form or support the cage base. The supporting frame members are integral parts of the cage body, which is formed by the frame members serving as wall elements therefor.

The exclusive use of sheet metal profile sections for the supporting frame cage provides a unitary construction system. A high angular stiffness of the supporting members can be achieved through the interconnection of the vertical and horizontal constructional elements. Reinforcing elements can be provided at the specifically stressed locations at the guides. Guide shoes and arresting devices can be mounted directly on the supporting frame members. Vertical supporting frame members and a wall element transversely connecting them form a complete side wall of the lift cage.

A further profile section element may be arranged parallel with and between base beams. By the incorporation of suspension points at a projecting end, cables and other carrying elements for the cage may be mounted. A lifting device, preferably of the hydraulic type, can be located between the guide rails and be coupled to the carrying elements.

BRIEF DESCRIPTION OF THE DRAWINGS

The present invention is explained in more detail in the following detailed description of illustrative embodiments in association with the attached drawings, in which.

DETAILED DESCRIPTION OF THE INVENTION

Figure 1:
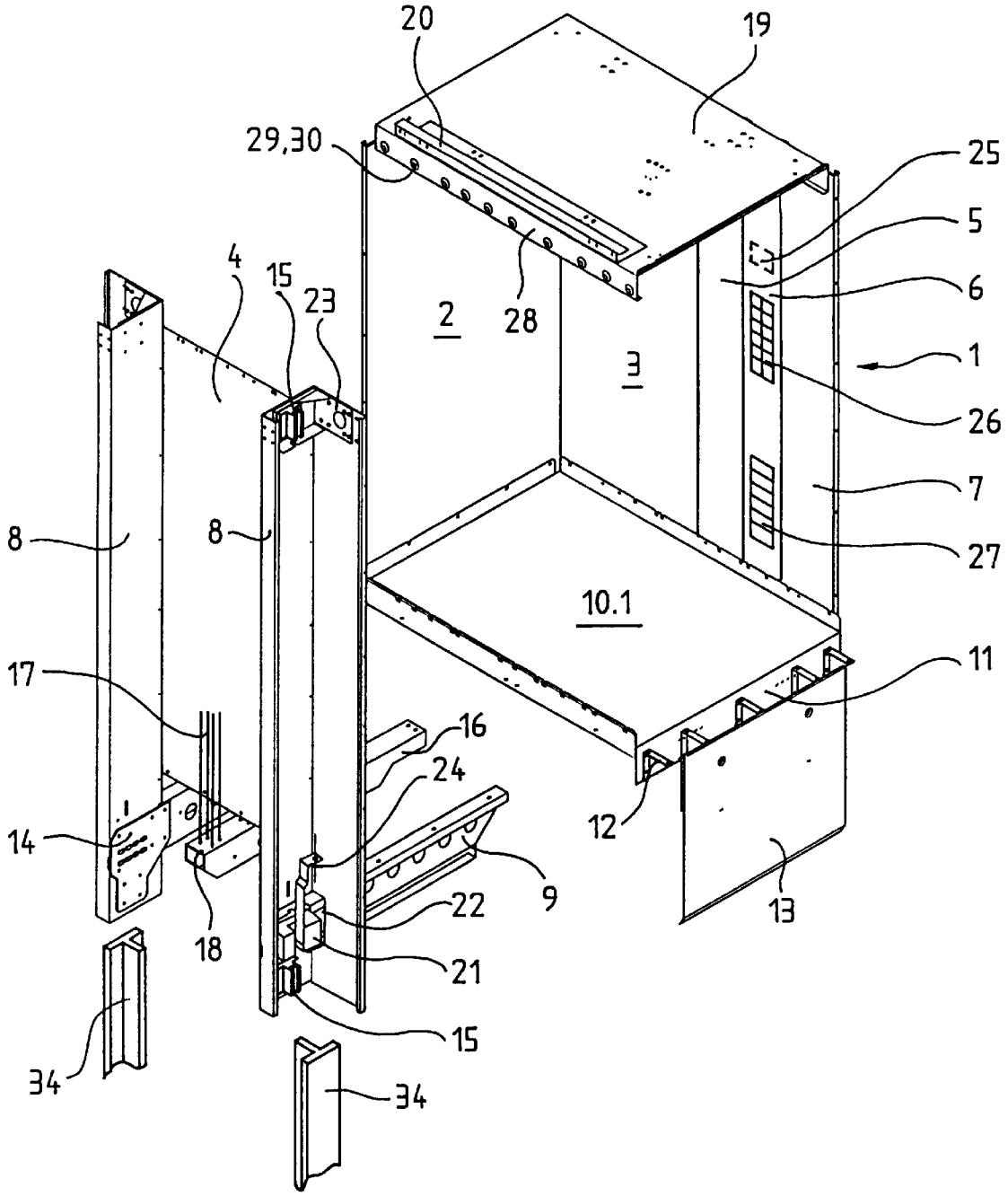
FIG. 1 shows a partially exploded view of a lift cage according to a first embodiment with separately illustrated supporting and compartment elements and with guidance at one side.
Figure 4:
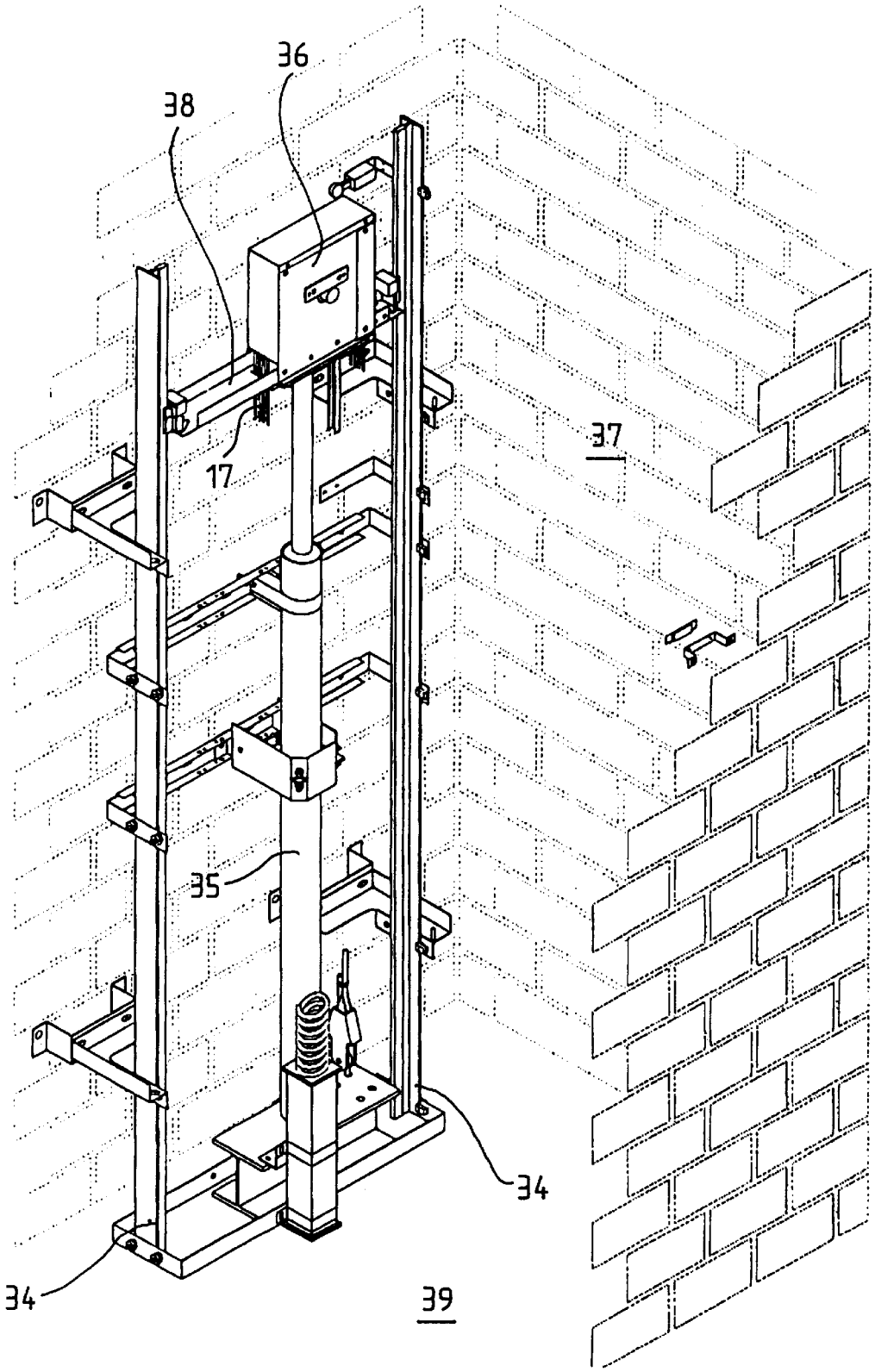
FIG. 4 shows, by way of example, a hydraulic cable drive for displacing the lift cage according to the invention.

A lift cage constructed as a compartment unit is designated by 1 in FIG. 1. A side wall, which is at the left when seen from the front of the lift cage comprises two vertical supporting frame members 8 each in the form of a sheet metal profile section, which are transversely connected by means of a first wide side wall member 4 to form the complete lefthand side wall of the lift cage. The two vertical supporting frame members or profile sections 8 are each in the general cross-sectional shape of a U with unequal arms or limbs about a floor base or portion when viewed in plan, and have in their lower part a respective passage opening 22 through the longer limb through which horizontal base beams 9 are guided. The base beams are screw-connected with the floor or base portion of the U-shaped profile section. This mode of fastening guarantees a high angular stiffness. A respective arresting device 21 with a trigger lever 24 is fastened to the base beam 9 and to each vertical supporting frame member 8, and is backed by a reinforcing plate 14 for the purpose of reinforcing the entire construction. A respective lower guide shoe 15 is disposed below each arresting device 21 at the lower end of the vertical supporting frame members 8. An upper guide shoe 15, reinforced by a guide shoe carrier bracket 23, is disposed at each of the upper ends of the vertical supporting frame members. One end of a carrier yoke 16 having suspension points 18 for supporting elements 17 projects outwardly below the side wall member 4. This orientation is especially suitable for a classic hydraulic cable drive (FIG. 4). As described and illustrated, the construction forms on the one hand a complete cantilever sling for the lift cage and on the other hand the entire lefthand side wall of the lift cage.

The separately illustrated additional compartment elements of the lift cage 1 substantially comprise a cage base 10.1, a back wall member 2, an opposite or second side wall 3 including a first narrow side wall member 5, a second narrow side wall member 7, and an indicator board carrier 6 arranged between the two narrow side wall members 5 and 7, and a cage ceiling 19. The cage base 10.1 has, along three sides, bent-up edges, to which the wall members 2, 3, 4, 5, 6, 7 and 8 are secured at their lower ends. It is apparent therefrom that the members 8 are both wall members and supporting frame members.

The cage base 10 has on its entrance side a downwardly bent front surface 11, to which are fastened carrier brackets 12 which carry an apron 13. The carrier brackets 12 are furthermore adapted for the reception of a threshold profile section (not illustrated). The carrier yoke 16 is led under the cage base 10.1 and is firmly connected therewith. In addition, the cage base 10.1 lies on the base beams 9, which are dimensioned appropriately to accept the maximum transport load intended to be incurred.

The cage base 10.1' is covered with a multi-layer sandwich plate (not illustrated) during manufacture of the lift cage. The cage wall members 2 to 8 may have an already prepared-for-use surface; sheet metal plates provided with a laminate, preferably a so-called "skin plate" may be used as a starting material. Decorative wall facings can additionally be applied as needed or desired. The indicator board carrier 6 is, in general terms, a conventional narrow wall member, but additionally provides for the incorporation of call transmitters 26, a story indicator 25 and a ventilation grill 27. The downwardly bent side edges 28 of the cage ceiling 19 have fastening points 29 for screw connections with the side and back wall members 2, 3, 4, 5, 6, 7 and 8. The fastening points 29 may incorporate spacers 30 for the purpose of creating an upper ventilation slot between the ceiling and wall members around the cage periphery. An additional connecting profile section 20 on the supporting frame side of the cage ceiling 19 may be connected to the supporting frame members 8 to provide additional reinforcement for the upper cage portion.

Guide rails 34, mounted in the lift shaft, are located adjacent the frame members 8 and define a guide plane between them which is at a right angle to the plane of the entrance front side of the lift cage 2.

Figure 2:
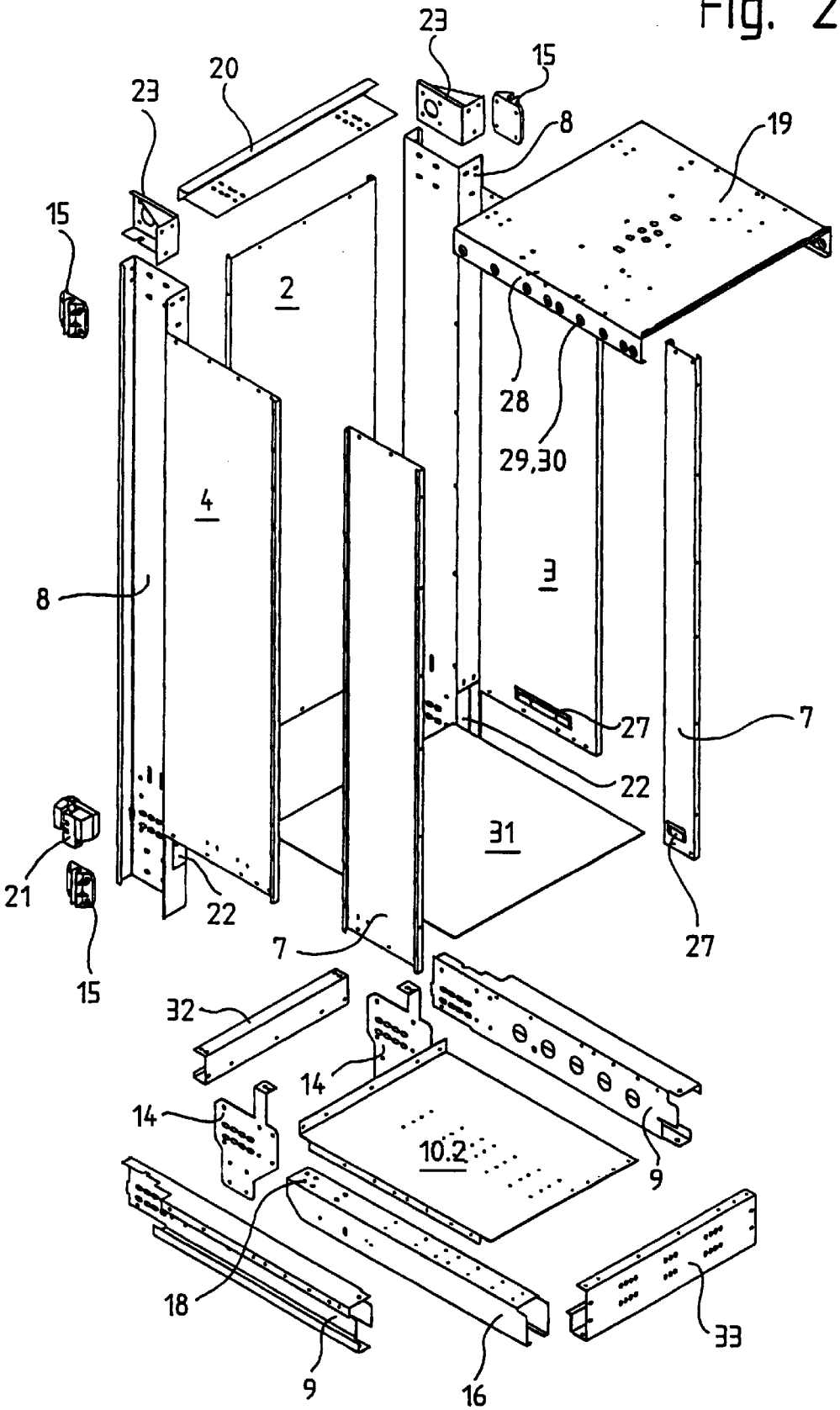
FIG. 2 shows a fully exploded view of a lift cage according to a second embodiment, with guidance at the rear side.

A second embodiment of lift cage 1 in accordance with the present invention is shown in FIG. 2, with the following modifications. This cage has a somewhat lighter construction for a smaller transport load and correspondingly differing dimensions.

In this embodiment, the guide plane formed by the guide rails 34 is parallel to the plane of the entrance front of the lift cage, and the cage-supporting frame in this variant is formed by the wall members of the cage back wall. Accordingly, a complete back wall or side wall of a lift cage 1 may be formed by assembling vertical supporting members 8 with one of the wall members 2 or 4.

The cage base part is of a multi-part construction, and comprises a cage base 10.2 with lateral downwardly bent-over edges and a rearward upwardly bent edge. The upper arms or limbs of the U-shaped base beams 9 form opposed edge portions of the cage base 10.2 at the same level as the surface of that of main cage base member. The base beams 9 accordingly are connected by their central base portions to the lateral downwardly bent edges of the cage base 10.2. The front side of the cage base 10.2 is formed by a screwed-on depending front profile section 33, while the rear side of the cage base 10.2 has an additional cross beam 32 affixed to its upturned rear edge. Both the cage base 10.2 and the upper limbs of the beams 9 are subsequently covered by a base coating or plate.

The intermediate space between the wall members 4 and 7 or between the wall members 3 and 7 is provided for the wall member constructed as the indicator board carrier 6 as shown in FIG. 1. The wall members 2 to 8 may be interconnected and jointed by clips (not shown) of conventional construction which engage about and hold together the edge folds of the wall members. The wall members 3 and 7 may have ventilation openings 27.

Figure 3:
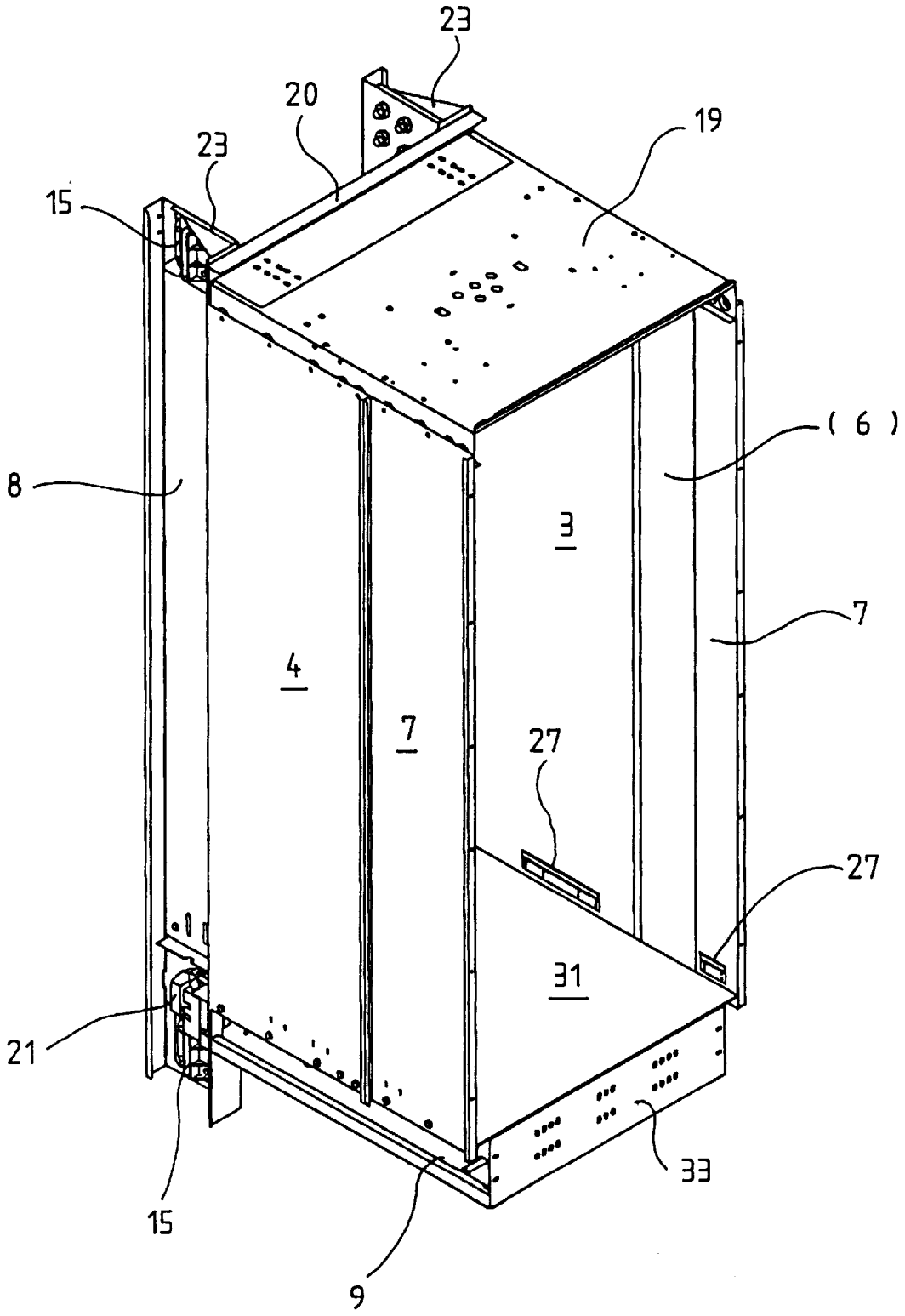
FIG. 3 shows the lift cage of FIG. 2 in the assembled state.

FIG. 3 shows an assembled cage according to FIG. 2. The inclusion of indicator board carrier 6 and a door drive (not shown) augment the cage body into the completed, installation-ready lift cage 1.

FIG. 4 shows by way of example a hydraulic cable drive which may be used for the lift cage 1 according to the invention. A hydraulic stroke cylinder 35 is arranged within the guide plane of the two guide rails 34 and is supported upon the base 39 of the shaft 37. An encased deflecting roller 36, around which the carrying elements 17 are looped, is disposed on the ram head of a piston mounted in the cylinder 35. A translation ratio of t=1:2 is achieved. A traveling guide cross girder 38 supports the ram head and prevents lateral buckling thereof.

The parts of the invention according to FIGS. 1 and 2 or 3 can be easily produced in large quantities. Only the indicator board carrier 6, the call transmitters 26 of which are provided in correspondence with the story numbers needed, constitute a subassembly dependent on specific order requirements. The door drive is a further independent and complete subassembly and completes, together with the indicator board carrier 6, as already explained, the construction of the cage body into an individual and finished cage body 1.

I claim:

1. A lift cage for a lift movable along vertical guide rails by a lifting device, comprising a base, a ceiling and side walls formed of sheet metal members, said base member and ceiling member having bent vertical edge portions, two of said side wall members extending downwardly below said base of the lift cage to form supporting frame members, said supporting frame members being connected to a pair of horizontal base beams extending below the lift cage base, the combination of supporting frame members and horizontal base beams forming a cantilever sling for the lift cage to permit guidance of the lift at the guide rails, the cage base being rigidly mounted to the cantilever sling.

2. A lift cage according to claim 1, wherein the vertical base support frame members are U-shaped in plan with unequal limbs joined by a base section, the base support frame members having passage openings, the base beams being inserted through the passage openings and being firmly connected to the base sections thereof.

3. A lift cage according to claim 1 or 2, characterized in that the supporting frame members have a reinforcing plate at a rear side proximate the location of the connected base beams.

4. A lift cage according to claim 1 or 2, characterized in that guide shoes co-operating with the guide rails are mounted to the supporting frame members.

5. A lift cage according to claim 4, wherein the guide shoes are mounted to the supporting frame members by carrier brackets.

6. A lift cage according to claim 2, characterized in that a carrier yoke is located between the base beams, the carrier yoke having lift suspension points projecting into a guide plane between the vertical guide rails.

7. A lift cage according to claim 2 or claim 6, characterized in that the base beams extend over the entire length of the cage base.

8. A lift cage according to claim 2, characterized in that at least one cross beam is mounted to the cage base.

9. A lift cage according to claim 2, characterized in that the sheet metal members and the supporting frame members form the inner walls of the lift cage.

10. A lift cage according to claim 2, characterized in that the sheet metal wall members have a laminate affixed to a surface thereof.

* * * * *

UNITED STATES PATENT AND TRADEMARK OFFICE

CERTIFICATE OF CORRECTION

PATENT NO. : 5,975,249

DATED : November 2, 1999

INVENTOR(S) : Fabrice Tomaseti

It is certified that error appears in the above-identified patent and that said Letters Patent is hereby corrected as shown below:

Column 4, line 20, delete "walls" and insert --wall members, said side wall members--.

Column 4, lines 20 and 21, delete "members, said base member and ceiling member".

Signed and Sealed this

Twenty-ninth Day of August, 2000

*Attest:*

*Attesting Officer*

Q. TODD DICKINSON

*Director of Patents and Trademarks*